US008437975B2

(12) United States Patent
Melbo et al.

(10) Patent No.: US 8,437,975 B2
(45) Date of Patent: May 7, 2013

(54) SUBSEA ACCUMULATOR MONITORING SYSTEM

(75) Inventors: Hallgeir Melbo, Bekkestua (NO); Klas Goran Eriksson, Asker (NO); Kristin Falk, Kolsas (NO)

(73) Assignee: Aker Subsea AS, Lysaker (NO)

( * ) Notice: Subject to any disclaimer, the term of this patent is extended or adjusted under 35 U.S.C. 154(b) by 549 days.

(21) Appl. No.: 12/446,288

(22) PCT Filed: Oct. 19, 2007

(86) PCT No.: PCT/NO2007/000370

§ 371 (c)(1),
(2), (4) Date: May 10, 2010

(87) PCT Pub. No.: WO2008/048109

PCT Pub. Date: Apr. 24, 2008

(65) Prior Publication Data

US 2010/0294383 A1 Nov. 25, 2010

(30) Foreign Application Priority Data

Oct. 20, 2006 (NO) ..... 20064750

(51) Int. Cl.
*F04B 51/00* (2006.01)
*G01F 17/00* (2006.01)

(52) U.S. Cl.
USPC ..... 702/114; 702/50; 702/98; 73/168; 73/149

(58) Field of Classification Search ..... 702/114, 702/50, 98; 73/168, 149; 700/301
See application file for complete search history.

(56) References Cited

U.S. PATENT DOCUMENTS 3,732,534 A 5/1973 Koomey et al.
3,775,736 A 11/1973 Koomey et al.

(Continued)

FOREIGN PATENT DOCUMENTS

GB 2318815 A 5/1998
WO 2006/059223 A3 6/2006

OTHER PUBLICATIONS

PCT Search Report dated Oct. 3, 2008 of Patent Application No. PCT/NO2007/000370 filed Oct. 19, 2007.
Good, Craig A; McAdams, James P: "Mathematical Prediction and Experimental Verification of Deep Water Accumulator Capacity" OTC 13234, Apr. 30, 2001, May 3, 2001.

(Continued)

*Primary Examiner* — Jonathan C Teixeira Moffat
*Assistant Examiner* — Regis Betsch
(74) *Attorney, Agent, or Firm* — Maine Cernota & Rardin

(57) ABSTRACT

The invention relates to a monitoring system and method for accumulator banks including at least two pressure accumulators, the accumulator bank is coupled to a device and being adapted to provide a pressurized fluid into the device at pressure reductions in said device. The monitoring system comprises at least one sensor for detecting a chosen parameter in the accumulator bank at chosen intervals of time, and a recording unit for recording the sampled measured parameters, a storage device for storing predetermined characteristic information related to the pressure development in the accumulator bank during pressure reductions at the device and representing different numbers of active accumulators in the accumulator bank, and calculation means for comparing the recorded measured parameters with the stored characteristic information, and determining from this comparison the number of active accumulators in the accumulator bank.

12 Claims, 2 Drawing Sheets

U.S. PATENT DOCUMENTS

| | | | | |
|---|---|---|---|---|
| 4,781,061 | A * | 11/1988 | Baumgartl | 73/149 |
| 6,092,878 | A * | 7/2000 | Watanabe | 303/115.4 |
| 6,305,471 | B1 | 10/2001 | Milloy | |
| 6,422,315 | B1 * | 7/2002 | Dean | 166/339 |
| 6,988,554 | B2 * | 1/2006 | Bodine et al. | 166/363 |
| 7,941,290 | B2 * | 5/2011 | Bredau et al. | 702/114 |
| 2007/0240882 | A1 * | 10/2007 | Leonardi et al. | 166/364 |

OTHER PUBLICATIONS

Sattler, Jeffry P: "BOP Subsea Hydraulic Accumulator Energy Availability, How to Ensure you Have What You Need" SPE 74469, Feb. 26, 2002, Feb. 28, 2002 XP002469979.

Norwegian Search Report dated May 18, 2007 of Patent Application No. 20064750 filed Oct. 20, 2006.

* cited by examiner

SUBSEA ACCUMULATOR MONITORING SYSTEM

RELATED APPLICATIONS

This application is a 371 U.S. National Phase of PCT Application No. PCT/NO2007/000370, filed Oct. 19, 2007, which claims Norwegian Patent Application No. NO 2006 4750, filed Oct. 20, 2006. Each of these applications is herein incorporated by reference in their entirety for all purposes.

FIELD OF THE INVENTION

This invention relates to a system for monitoring the performance of subsea equipment e.g. in relation to oil/gas installations, and particularly accumulator banks associated with pumps.

BACKGROUND OF THE INVENTION

In oil/gas installations there are several units positioned at the sea floor or downhole in oil or gas wells, performing necessary tasks in order to control the production or to transport the hydrocarbons from the well to the sea surface or to land. Many of these units contain equipment being subject to wear and thus have to be repaired or replaced from time to time. These intervals depend on use and the conditions on location, and are therefore difficult to predict. The result is an occasional emergency stop in the production.

SUMMARY OF THE INVENTION

It is an object of this invention to provide a solution that enables the operator to detect how many of the accumulators are still operative, and to consider whether the accumulators should be replenished or if maintenance may be necessary.

In the particular type of subsea pumping system addressed here, an accumulator bank of a multitude of hydraulic accumulators is used for storing energy for maintaining overpressure in the subsea pump during cool-down in the system. If e.g. the topside plant is suddenly shut down, the subsea pump stops and gradually cools down. The dielectric oil inside the motor contracts, and a lube oil supply represented by the accumulator bank is thus needed in order to maintain the slight overpressure of dielectric oil compared to the fluid pressure inside the pump.

The lube oil supply of such an accumulator bank will be reduced during use, and the accumulators will stop working one by one.

It is an additional object of the present invention to provide an estimated time to service based on measurements provided from the accumulator bank so as to reduce the downtime of subsea equipment by replacing or repairing the subsea accumulators at the right time.

These objects are obtained with a system and method as described in the accompanying independent claims.

The present invention thus reduces the downtime of the system by giving the operator sufficient time to prepare the maintenance before the system stops working completely.

BRIEF DESCRIPTION OF THE DRAWINGS

The invention will be described more in detail below with reference to the accompanying drawings, illustrating the invention by way of examples.

DETAILED DESCRIPTION

Figure 1:
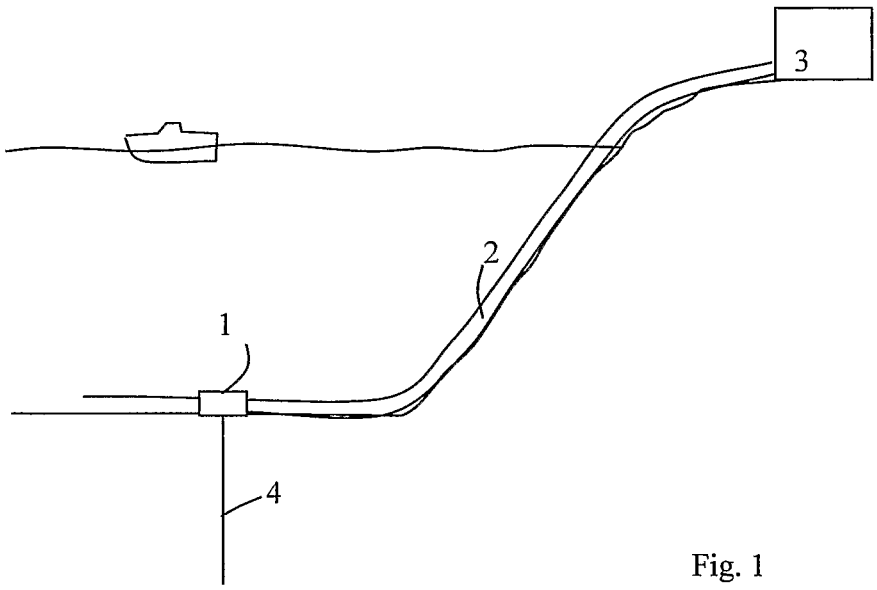
FIG. 1 illustrates schematically the installation comprising the pump.

FIG. 1 illustrates the situation in which the invention is to be used, with a subsea pump 1 and an umbilical 2 extending toward an onshore or topside monitoring unit 3. The signals from the sensors positioned in the pump are transmitted through conductors in the umbilical to the onshore unit. The umbilical also feeds the accumulators with lube oil such that the accumulators are re-charged after they have provided fluid to the pump.

Figure 2:
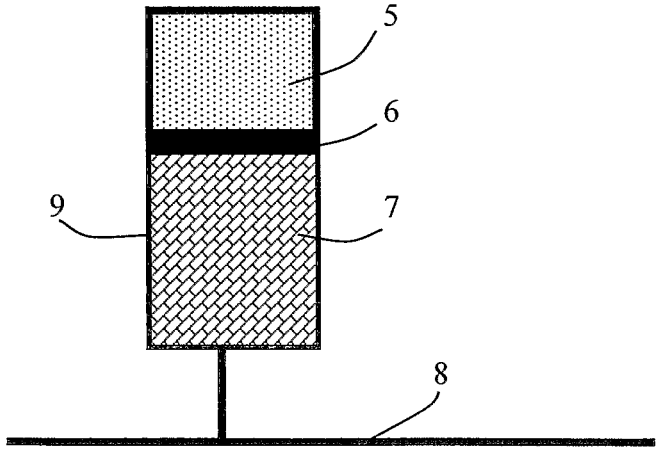
FIG. 2 illustrates an accumulator bank.

FIG. 2 illustrates a hydraulic accumulator 9 used as an energy storing device, of bladder or piston type. The hydraulic accumulator 9 in FIG. 2 includes a chamber 5,7 in which is arranged a freely moving piston 6, which seals against the chamber walls. On one side 5 of the piston is a gas (usually nitrogen), and on the other side 7 is the hydraulic fluid. As the pressure in the system increases, fluid is forced into the accumulator, the piston moves upwards, and the gas is compressed to a higher pressure. Several such accumulators are available, e.g. from Tobul Accumulator, Inc.

If the amount of fluid in the system decreases, the gas presses the piston downwards, and hydraulic fluid is forced out into the system. The effect is that the accumulator dampens pressure fluctuations in the system. The amount of dampening depends on the amount of pressurised gas, i.e. the volume of the accumulator.

Often a multitude of smaller accumulators are connected together in order to provide larger capacity than a single accumulator can provide. Such an arrangement is usually called an accumulator bank.

If a certain amount of fluid (e.g. 1 liter) is suddenly drawn from the system, the pressure will drop a certain amount (e.g. 10 Bar). How much the pressure drops when 1 liter fluid is suddenly removed depends on the size of the accumulator.

Over time some of the gas above the piston (the "pre-charge") may leak out, which reduced the efficiency of the accumulator (i.e. the pressure will decrease more when 1 liter of fluid is suddenly extracted). Once gas begins leaking out, it usually does not take long before all the gas has disappeared into the surrounding environment, after which point the accumulator no longer works as an accumulator. For a bank of accumulators, the individual accumulators usually stop working one at a time, more or less at random.

In the particular type of subsea pumping system we are addressing, an accumulator bank of a multitude of hydraulic accumulators is used to maintain overpressure in the subsea pump during cool-down. In one typical implementation a bank of 8, 20 liter accumulators was used.

If e.g. the topside plant 3 is suddenly shut down, the subsea pump 1 stops and gradually cools down. The dielectric oil inside the motor contracts, and a lube oil supply is thus needed in order to maintain the slight overpressure. The overpressure may be controlled via a mechanical regulator.

The lube oil accumulator bank contains sufficient volume to be able to supply all oil needed for a complete cool-down under worst case condition. There is also some additional capacity such that if a few accumulators fail, the size of the bank will still be sufficient.

Over time, the accumulators will stop working one by one. When e.g. three have stopped working, the accumulator bank can no longer maintain the overpressure in worst case conditions, and a pump module change-out should then be contemplated.

According to a preferred embodiment of the invention the pressure at the accumulator bank is measured, and from the time/pressure curve the deterioration in the accumulator bank can be determined. The problem is to determine how many accumulators in a bank of e.g. 8 are operational from the pressure/time curve during a cool-down event. One variable worth noting is that the fewer accumulators that are in service, the deeper will the pressure dip be in the system during a cool-down.

Furthermore, based on when e.g. the first and second accumulator ceased working, one may anticipate when the third one is likely to stop working, and plan maintenance/intervention accordingly.

The performance of an accumulator or accumulator bank can be inferred from the pressure drop as fluid is consumed, but until now no prediction of time to service is made for an accumulator bank. The normal solution is to implement an alarm when the pressure drops too low. This, however, is not an ideal solution.

When the alarm is given, the state of the accumulator bank is so bad that the need for service/maintenance/intervention is imminent. With a simple static alarm, the setting is set so low as not to trigger nuisance alarms, which in turn means that when an alarm is finally given, the state of the accumulator bank has deteriorated much. The subsea accumulator bank is usually replenished via the umbilical 2.

The difference in pressure drop depending on whether all 8 accumulators are working, or only 7 out of 8, is not much, and is not readily detected.

In accordance with the invention, the pressure in the subsea accumulator bank is monitored. The time variation of this pressure is also simulated, by means of a process model. The simulations are done for various numbers of active accumulators, and by comparison with the measured pressure curve the number of active accumulators is estimated.

The simulated pressure-time curve needs to be compensated for the temperature at the time the pump stopped, so in a preferred embodiment a temperature sensor is also provided in the areas containing lube oil inside the pump. There is a difference if the pump was hot or just lukewarm at the time the cool-down starts as the amount the lube oil volume shrinks depends on the delta temperature, which in turn depends on the initial temperature.

The process may be modelled in various ways. A simple process model for this system can, for instance, be expressed as a differential equation, where the pressure at the accumulator bank is differentiated with respect to time:

$$\frac{dP}{dt} = \kappa(Q_{in} - Q_{out})/N$$

Here P is the pressure at the accumulator bank, $Q_{in}$ is the flow of lube oil into the accumulator bank, $Q_{out}$ is the flow out of the accumulator bank, N is the number of active accumulators, and κ is some constant. The inflow comes from the umbilical, and a simple umbilical model can be expressed as follows:

$$Q_{in}=\beta(P_{top}-P+c_0),$$

where $P_{top}$ is the pressure at the topside end of the umbilical, $c_0$ is the static pressure drop due to gravity, and β is some constant. The flow out of the accumulators depend on the cooling of the pump, and assuming a standard cool-down behaviour, the outflow can be estimated as $$Q_{out}=\alpha\gamma(T_0-T_\alpha)e^{-\gamma t},$$

in which $T_0$ is the initial lube oil temperature in the pump when the pump stops, $T_a$ is the temperature of the water surrounding the pump, and α and γ are constants. The process model is now fully described. Instead of running this model at the time of the analysis, this step may be replaced by use of tabulated values.

Figure 3:
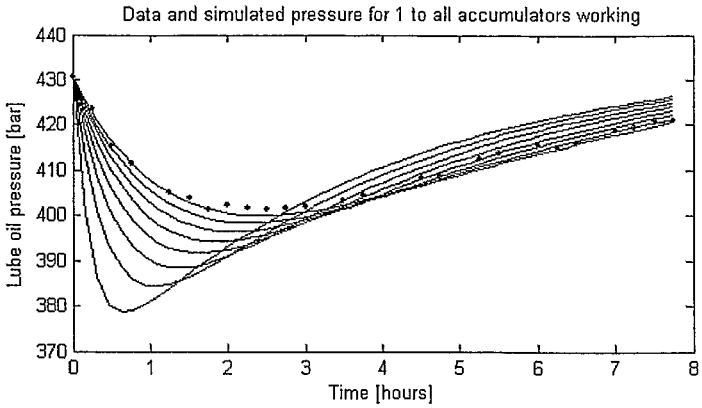
FIG. 3 illustrates the pressure development in the system with one or more accumulators working.

FIG. 3 shows the simulated pressure/time curves for 1 to 8 working accumulators. The dots are the measured data. In this case the best fit between the data and the simulated curves is obtained for 8 working accumulators. As is evident from FIG. 3 the pressure per se may not be used as an indicator for the situation in the accumulator bank, but the measured time development may be detectable by comparison with the simulated curves.

The accumulator bank is usually sized such that 3 out of 8 accumulators can be out of service, and the remaining 5 then have sufficient capacity to maintain the fluid pressure under worst case conditions. This may vary between implementations, but these values are typical for the system described in this example.

By noting when accumulator #1 and #2 ceased working, one may thus extrapolate when accumulator#3 will stop working, and plan maintenance accordingly.

One may also adopt the philosophy that when accumulator#2 fails, intervention is made whenever practical (e.g. within 1 month) knowing that the system will be fully operational for some time.

To summarize, one embodiment of the invention relates to a method or system including at least two accumulators, for estimating the number of active accumulators in a subsea accumulator bank comprising:

- A process model or tabulated values, e.g. in a simulator running several scenarios with varying numbers of active accumulators.
- A dataset from the cooldown containing values for:
  - A subsea pressure sensor monitoring accumulator pressure
  - One or more subsea temperature sensors giving the initial lube oil temperature inside the pump before cooldown.
- A selector selecting the curve from the model tabulated values or simulations which fits best and thereby determining how many accumulators are in use.

The system and method comprising at least one sensor for detecting a chosen parameter, in the accumulator bank at chosen intervals of time, and a recording unit for recording the sampled measured parameters. The main parameter will preferably be pressure but other related parameters like temperature may be contemplated alone or together with pressure information.

A storage device in the system contains characteristic information related to the pressure development in the accumulator bank during pressure reductions at the device and representing different numbers of active accumulators in the accumulator bank. This information may be based on models, like mentioned above, or previously sampled and statistically prepared data about the system under similar circumstances. The stored information will preferably be related to pressure, but temperature related information may also be stored.

The calculation means for comparing the recorded measured parameters with the stored characteristic information, e.g. pressure and temperature related information, and determining from this comparison the number of active accumulators in the accumulator bank, may be positioned anywhere, e.g. on shore, and it needs not to be physically linked to the pumping system.

The data set and/or the selected curves are registered at chosen intervals of time providing a basis for extrapolation so as to enable the system to predict the future development of the situation, thus providing an estimated time to service. This may enable the system to calculate the time for maintenance, as is described more closely in the simultaneously filed patent Norwegian patent application No. 20064749 and the corresponding PCT-application which are included here by way of reference.

The invention claimed is:

1. A monitoring system for an accumulator bank, said accumulator bank including N accumulators, where N is greater than 1, and where M accumulators are active, M being between 0 and N, the accumulator bank being coupled to a device and being adapted to provide a pressurized fluid into the device in response to pressure reductions in said device, the monitoring system comprising:

at least one sensor for detecting at least one chosen parameter of the accumulator bank at chosen intervals of time;

a recording unit for recording measurements of the chosen parameters;

a storage device for storing predetermined characteristic information related to the pressure development in the accumulator bank during pressure reductions at the device and representing different numbers of active accumulators in the accumulator bank; and calculation means for comparing the recorded parameters with the stored characteristic information, and determining from this comparison the value of M, for all possible values of M.

2. The system according to claim 1, wherein the measured parameter is the pressure in the accumulator bank.

3. The system according to claim 2, further comprising means for measuring the temperature in the accumulator bank at chosen intervals of time, the temperature also being recorded in the storage device and the calculation means being adapted to comparing both recorded pressure and temperature in said tanks with the stored characteristic information, said stored characteristic information also including information related to temperature.

4. The system according to claim 1, wherein the stored characteristic information is a predetermined mathematical model describing the system reactions to a pressure reduction with different numbers of accumulators.

5. The system according to claim 1, wherein the stored characteristic information is a statistical representation of previously sampled information from corresponding pressure reductions in the system.

6. The system according to claim 1, wherein the recorded parameters are registered and the calculation means are adapted to compare the registered information and to provide prediction data indicating the probable time to service, defined by a minimum number of active accumulators.

7. A method for monitoring an accumulator bank, said accumulator bank including N accumulators, where N is greater than 1, and where M accumulators are active, M being between 0 and N, the accumulator bank being coupled to a device and being adapted to provide a pressurized fluid into the device simultaneously from each accumulator in the bank in response to pressure reductions in said device, the method comprising:

detecting at least one chosen parameter of the accumulator bank at chosen intervals of time;

recording measurements of the chosen parameters;

comparing the recorded measurements of the recorded parameters with stored characteristic information related to pressure development in the accumulator bank during pressure reductions at the device for different numbers of active accumulators in the accumulator bank; and determining from this comparison the value of M, for all possible values of M.

8. The method according to claim 7, wherein the measured parameter is the pressure in the accumulator bank.

9. The method according to claim 8, wherein the temperature in the accumulator bank is also measured at chosen intervals of time, the stored characteristic information including temperature related information, and the measured temperature also being compared with the stored characteristic information.

10. The method according to claim 7, wherein the stored characteristic information is a predetermined mathematical model describing the system reactions to a pressure reduction with different numbers of accumulators.

11. The method according to claim 7, wherein the stored characteristic information is a statistical representation of previously sampled information from corresponding pressure reductions in the system.

12. The method according to claim 7, wherein the recorded parameters are registered and the calculation means are adapted to compare the registered information and to provide prediction data indicating the probable time to service, defined by a minimum number of active accumulators.

* * * * *